US009151188B2

(12) United States Patent
Hayashi

(10) Patent No.: US 9,151,188 B2
(45) **Date of Patent: *Oct. 6, 2015**

(54) VALVE TIMING CONTROLLER

(71) Applicant: DENSO CORPORATION, Kariya, Aichi-pref. (JP)

(72) Inventor: Masashi Hayashi, Okazaki (JP)

(73) Assignee: DENSO CORPORATION, Kariya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/018,454

(22) Filed: Sep. 5, 2013

(65) Prior Publication Data

US 2014/0090611 A1 Apr. 3, 2014

(30) Foreign Application Priority Data

Sep. 28, 2012 (JP) ..... 2012-216397

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01); *F01L 2001/34433* (2013.01); *F01L 2101/00* (2013.01); *F01L 2820/031* (2013.01)

(58) Field of Classification Search
CPC ..... F01L 1/344; F01L 1/3442; F01L 2001/34433; F01L 2101/00
USPC ..... 123/90.15, 90.17
See application file for complete search history.

(56) References Cited

U.S. PATENT DOCUMENTS

| | | | | |
|---|---|---|---|---|
| 7,484,486 | B2 * | 2/2009 | Knecht et al. | 123/90.31 |
| 7,717,074 | B2 * | 5/2010 | Kleiber et al. | 123/90.17 |
| 8,844,486 | B2 * | 9/2014 | Hayashi et al. | 123/90.17 |

FOREIGN PATENT DOCUMENTS

DE 102008030058 A1 * 2/2010

* cited by examiner

*Primary Examiner* — Ching Chang
(74) *Attorney, Agent, or Firm* — Nixon & Vanderhye P.C.

(57) ABSTRACT

A valve timing controller includes a rotation transmit component; a housing including an outer shape part fixed to the rotation transmit component and a plurality of partition parts extending from the outer shape part inward in a radial direction; and a vane rotor including a boss part and a plurality of vane parts radially extending from the boss part. The vane rotor is rotated relative to the housing on an advance side or a retard side according to a pressure of operation oil in an advance chamber and a retard chamber. The outer shape part of the housing has a dome shape.

15 Claims, 15 Drawing Sheets

VALVE TIMING CONTROLLER

CROSS REFERENCE TO RELATED APPLICATION

This application is based on Japanese Patent Application No. 2012-216397 filed on Sep. 28, 2012, the disclosure of which is incorporated herein by reference in its entirety.

TECHNICAL FIELD

The present disclosure relates to a valve timing controller.

BACKGROUND

A valve timing controller changes a rotation phase between a driving shaft and a driven shaft of an internal combustion engine so as to control opening-and-closing timing of an air intake valve or an exhaust valve driven by the driven shaft. JP-2005-520084A (U.S. Pat. No. 7,484,486 B2) describes a valve timing controller which changes the opening-and-closing timing by rotating a vane rotor relative to a housing through a change in oil pressure of the advance chamber and the retard chamber in the housing. A closing ring covers the housing, and at least one of the housing and the closing ring is made of resin composite material containing resin, inorganic compound, and glass fiber at a predetermined ratio.

Oil in the advance chamber and the retard chamber pushes the housing in the radial direction, and pushes the closing ring and a cover disk which covers another side of the housing in the axial direction. A corner part between the housing and the closing ring or the cover disk receives the stress in the radial direction and the stress in the axial direction, so the stress is concentrated to the corner part. So, the strength required for the housing, especially the corner part, is large.

In a case where the housing is made from resin composite material, if the thickness of the housing is increased to secure the strength, a void may be generated inside the resin, the accuracy of dimension may be lowered by a shrinkage, and the weight becomes large and the material cost becomes high because a large amount of resin is used.

On the other hand, if the thickness of the housing is decreased, the size of the advance chamber and the retard chamber cannot be made larger, and it is necessary to use an expensive resin material which can accept high stress.

SUMMARY

It is an object of the present disclosure to provide a valve timing controller which is designed to reduce a needed strength of a housing.

According to an example of the present disclosure, a valve timing controller which controls opening-and-closing timing of an intake valve or an exhaust valve of an internal combustion engine, which is driven by a driven shaft, by changing a rotation phase of the driven shaft to a driving shaft includes a rotation transmit component, a housing, and a vane rotor. The rotation transmit component is rotatable integrally with one of the driving shaft and the driven shaft. The housing includes an outer shape part fixed to the rotation transmit component and a plurality of partition parts extending from the outer shape part inward in a radial direction so as to partition inside of the outer shape part into a plurality of oil pressure chambers. The vane rotor includes a boss part which is rotatable integrally with the other of the driving shaft and the driven shaft inside the housing and a plurality of vane parts radially extending from the boss part so as to divide each of the oil pressure chambers into an advance chamber and a retard chamber. The vane rotor is relatively rotated relative to the housing on an advance side or a retard side according to a pressure of operation oil in the advance chamber and the retard chamber. The outer shape part of the housing has a dome shape.

Therefore, the pressure of oil in the advance chamber and the retard chamber is applied to the outer shape part of the housing uniformly, so the stress concentration is restricted. Thus, the needed strength of the housing can be made small, thereby raising the design flexibility, for example, the material and the thickness of the housing, the rib shape, and the size of the advance chamber and the retard chamber can be flexibly set. In a case where the housing is made from resin or resin composite material, the thickness of the housing can be made comparatively thin. Therefore, void is restricted from being generated in resin, the accuracy of dimension is raised by avoiding a shrinkage, and the use amount of resin can be reduced.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
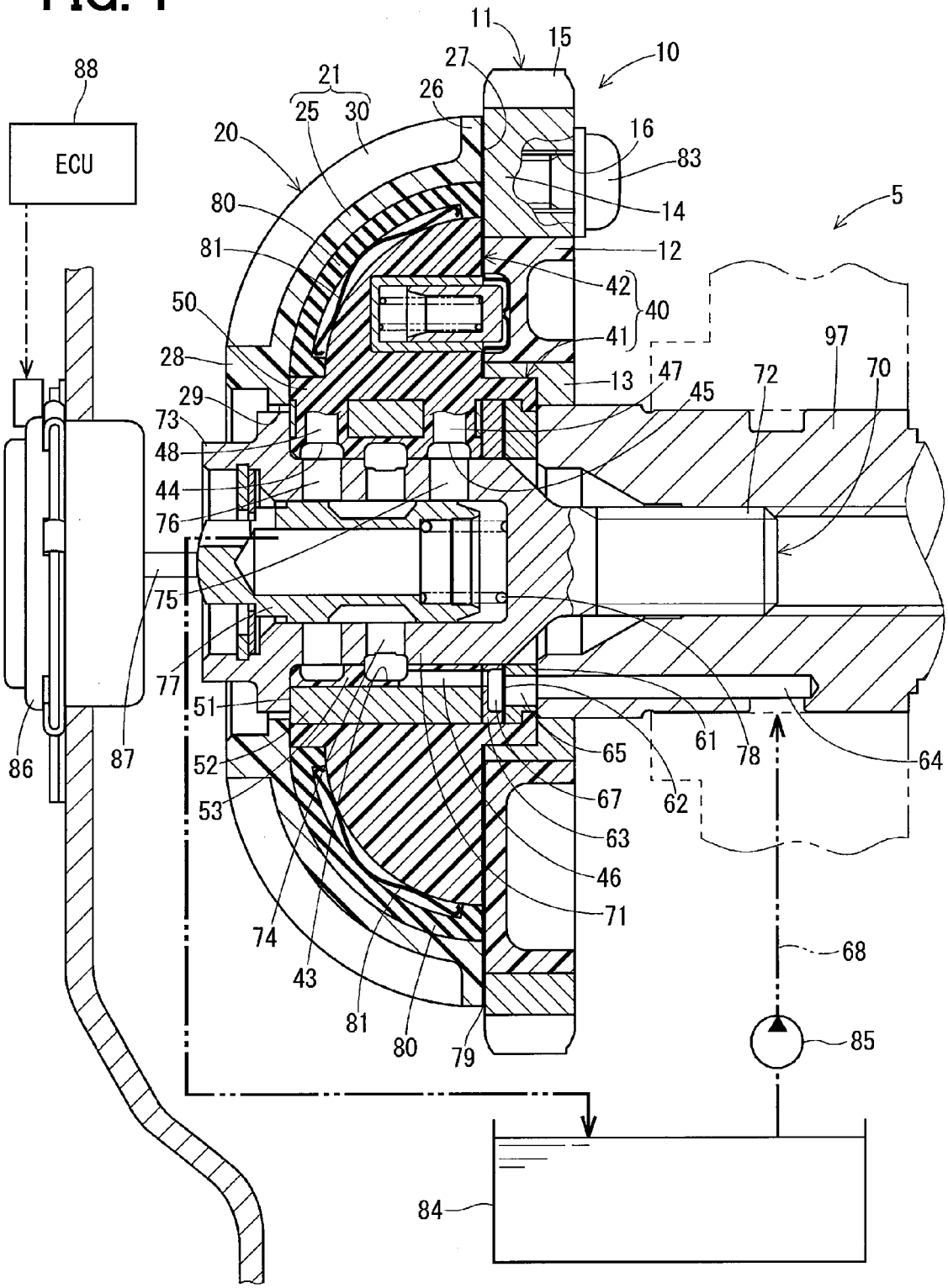
FIG. 1 is a schematic view illustrating a valve timing control system having a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2:
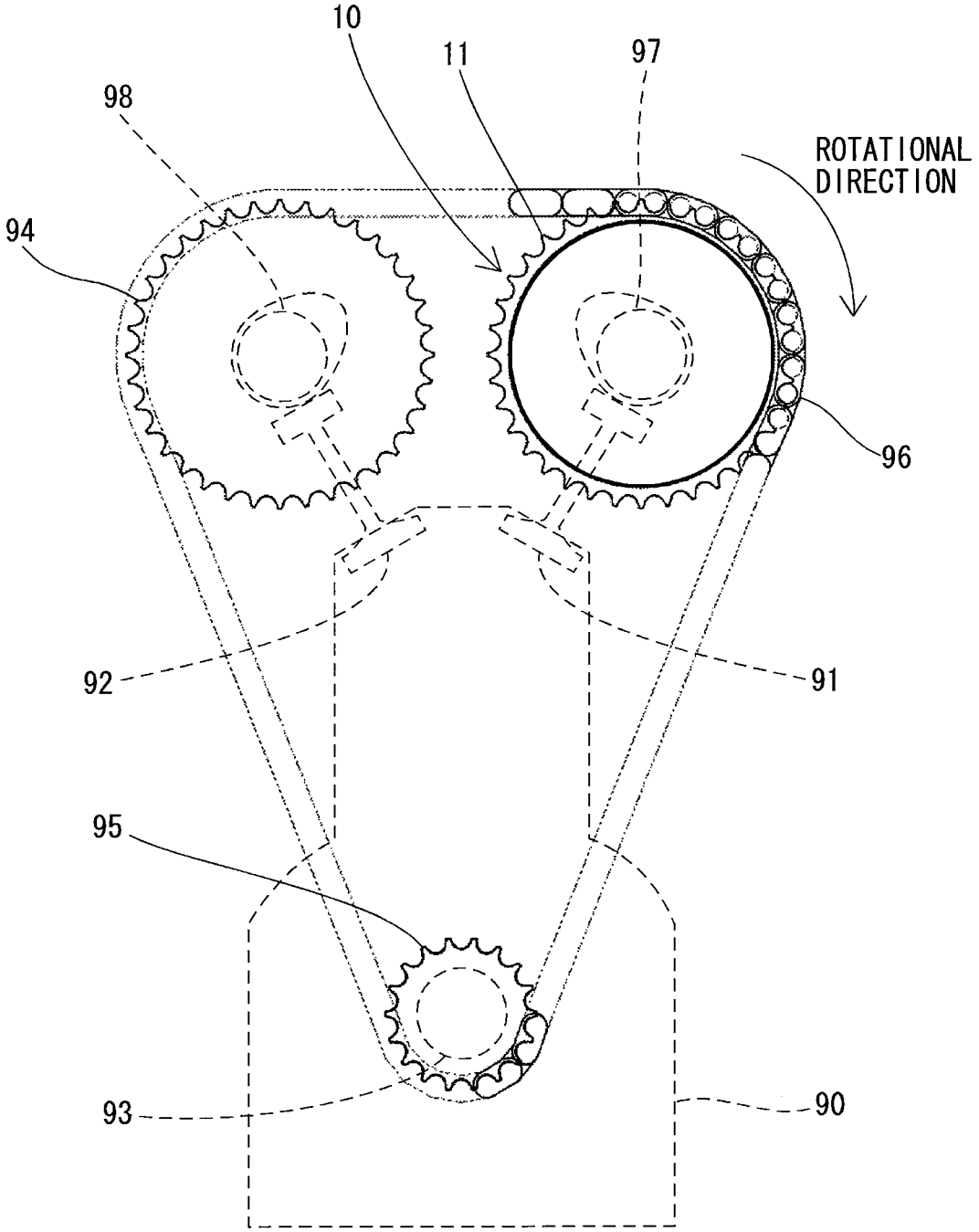
FIG. 2 is a schematic view illustrating an internal combustion engine to which the valve timing controller is applied.

A valve timing controller 10 according to a first embodiment is applied to a valve timing control system 5 shown in FIG. 1. The valve timing control system 5 is used for controlling opening-and-closing timing of an intake valve 91 of an internal combustion engine 90 shown in FIG. 2. As shown in FIG. 2, rotation of a crankshaft 93 (driving shaft) of the engine 90 is transmitted to a camshaft 97 and a camshaft 98 through a chain 96 wound around sprockets 11, 94, 95. The camshaft 97 is a driven shaft which opens or closes the intake valve 91, and the camshaft 98 is a driven shaft which opens or closes an exhaust valve 92.

The valve timing control system 5 rotates the camshaft 97 relative to a sprocket 11 integrally rotating with the crankshaft 93 in a rotational direction, thereby advancing the opening-and-closing timing of the intake valve 91. The camshaft 97 is advanced to make the opening-and-closing timing of the intake valve 91 early.

Moreover, the valve timing control system 5 rotates the camshaft 97 relative to the sprocket 11 in an opposite direction opposite from the rotational direction, thereby retarding the opening-and-closing timing of the intake valve 91. The camshaft 97 is retarded to make the opening-and-closing timing of the intake valve 91 late.

The valve timing control system 5 is explained with reference to FIGS. 1, 3 and 4. As shown in FIG. 1, the valve timing control system 5 includes an oil pump 85, a linear solenoid 86, an electronic control unit 88 and the valve timing controller 10.

The valve timing controller 10 includes a housing 20, a vane rotor 40, a sleeve bolt 70, a spool 77 and the sprocket 11. The sprocket 11 may correspond to a rotation transmit component, and rotates integrally with the crankshaft 93. The housing 20 has an outer shape part 21 fixed to the sprocket 11, and plural partition parts 22 extending from the outer shape part 21 inward in the radial direction so that the inside of the outer shape part 21 is divided into plural oil pressure chambers.

The vane rotor 40 is arranged in the housing 20, and is rotatable relative to the housing 20. The vane rotor 40 has a boss part 41 and plural vane parts 42. The boss part 41 has a cylindrical shape, and is rotatable integrally with the camshaft 97. The vane part 42 extends outward in the radial direction from the boss part 41 so that the oil pressure chamber in the housing 20 is divided into an advance chamber 23 and a retard chamber 24. The boss part 41 has a supply groove 43, a retard groove 44, an advance groove 45, a supply oil passage 46, an advance oil passage 47, and a retard oil passage 48. The supply groove 43 and the retard groove 44 have annular shape and are formed on a radially inner wall of the boss part 41. The advance groove 45 has a C shape and is formed on the radially inner wall of the boss part 41. The supply oil passage 46 extends from the supply groove 43 toward the camshaft 97 in the axial direction. The advance oil passage 47 extends from the advance groove 45 outward in the radial direction, and communicates with the advance chamber 23. The retard oil passage 48 extends from the retard groove 44 outward in the radial direction, and communicates with the retard chamber 24. The vane rotor 40 has a relative rotation relative to the housing 10 according to the pressure of operation oil in the advance chamber 23 and the retard chamber 24 on the advance side shown in the arrow direction Y1 direction in FIG. 4 or on the retard side shown in the arrow direction Y2 in FIG. 4.

A first ring 61, a reed valve 62, and a second ring 63 are arranged between the vane rotor 40 and the camshaft 97. The first ring 61 has a supply oil passage 65 which communicates with a supply oil passage 64 of the camshaft 97. The second ring 63 has a supply oil passage 67 which communicates with a supply oil passage 46 of the vane rotor 40. The reed valve 62 interposed between the first ring 61 and the second ring 63 is a check valve which allows the operation oil to flow from the supply oil passage 65 to the supply oil passage 67 and which prohibits the operation oil from flowing from the supply oil passage 67 to the supply oil passage 65.

The sleeve bolt 70 has a sleeve part 71, a screw part 72 and a head part 73. The sleeve part 71 has a based cylindrical shape and is fitted to the boss part 41 of the vane rotor 40. The screw part 72 extends from a bottom portion of sleeve part 71 adjacent to the sprocket 11 in the axial direction, and is screwed into the camshaft 97. The head part 73 is formed at the open end of the sleeve part 71. The sleeve part 71 has a supply port 74, an advance port 75 and a retard port 76. The supply port 74 has an axial position in agreement with the supply groove 43, and is made of a through hole extending in the radial direction. The advance port 75 has an axial position in agreement with the advance groove 45, and is made of a through hole extending in the radial direction. The retard port 76 has an axial position in agreement with the retard groove 44, and is made of a through hole extending in the radial direction. The supply port 74, the advance port 75, and the retard port 76 may correspond to a plurality of oil ports. The sleeve bolt 70 is inserted in the boss part 41 of the vane rotor 40, so as to fix the boss part 41 to the camshaft 97.

The spool 77 is able to reciprocate in the axial direction inside the sleeve part 71 of the sleeve bolt 70. When the spool 77 is moved in the axial direction, the communication/interception state of the oil ports is changed. The spool 77 is biased toward the linear solenoid 86 by a spring 78. The axial position of the spool 77 is determined by a balance between the biasing force of the spring 78 and the thrust force of the linear solenoid 86.

The oil pump 85 supplies the operation oil pumped from an oil pan 84 to the supply port 74 via the supply oil passage 68, 64, 65, 67, 46 and the supply groove 43.

The linear solenoid 86 has an output rod 87 which is capable to press the spool 77 in the axial direction. The output rod 87 moves in the axial direction according to a magnetic field generated when electricity is supplied to a coil inside the linear solenoid 86.

The electronic control unit 88 controls the axial position of the spool 77 by driving the linear solenoid 86 in a manner that the rotation phase of the vane rotor 40 relative to the housing 20 is in agreement with a target phase.

In the valve timing control system 5, when the rotation phase is located on the retard side from the target phase, the electronic control unit 88 controls the axial position of the spool 77 in a manner that the supply port 74 and the advance port 75 communicate with each other. Thereby, the operation oil is supplied to the advance chamber 23 of the valve timing controller 10, and the operation oil of the retard chamber 24 is discharged via the outside of the spool 77.

In contrast, when the rotation phase is located on the advance side from the target phase, the electronic control unit 88 controls the axial position of the spool 77 in a manner that the supply port 74 and the retard port 76 communicate with each other. Thereby, the operation oil is supplied to the retard chamber 24 of the valve timing controller 10, and the operation oil of the advance chamber 23 is discharged via the inside of the spool 77.

When the rotation phase is in agreement with the target phase, the electronic control unit 88 controls the axial position of the spool 77 in a manner that the supply port 74 is disconnected from the advance port 75 and the retard port 76. Thereby, the operation oil in the advance chamber 23 and the retard chamber 24 of the valve timing controller 10 is maintained.

Figure 3:
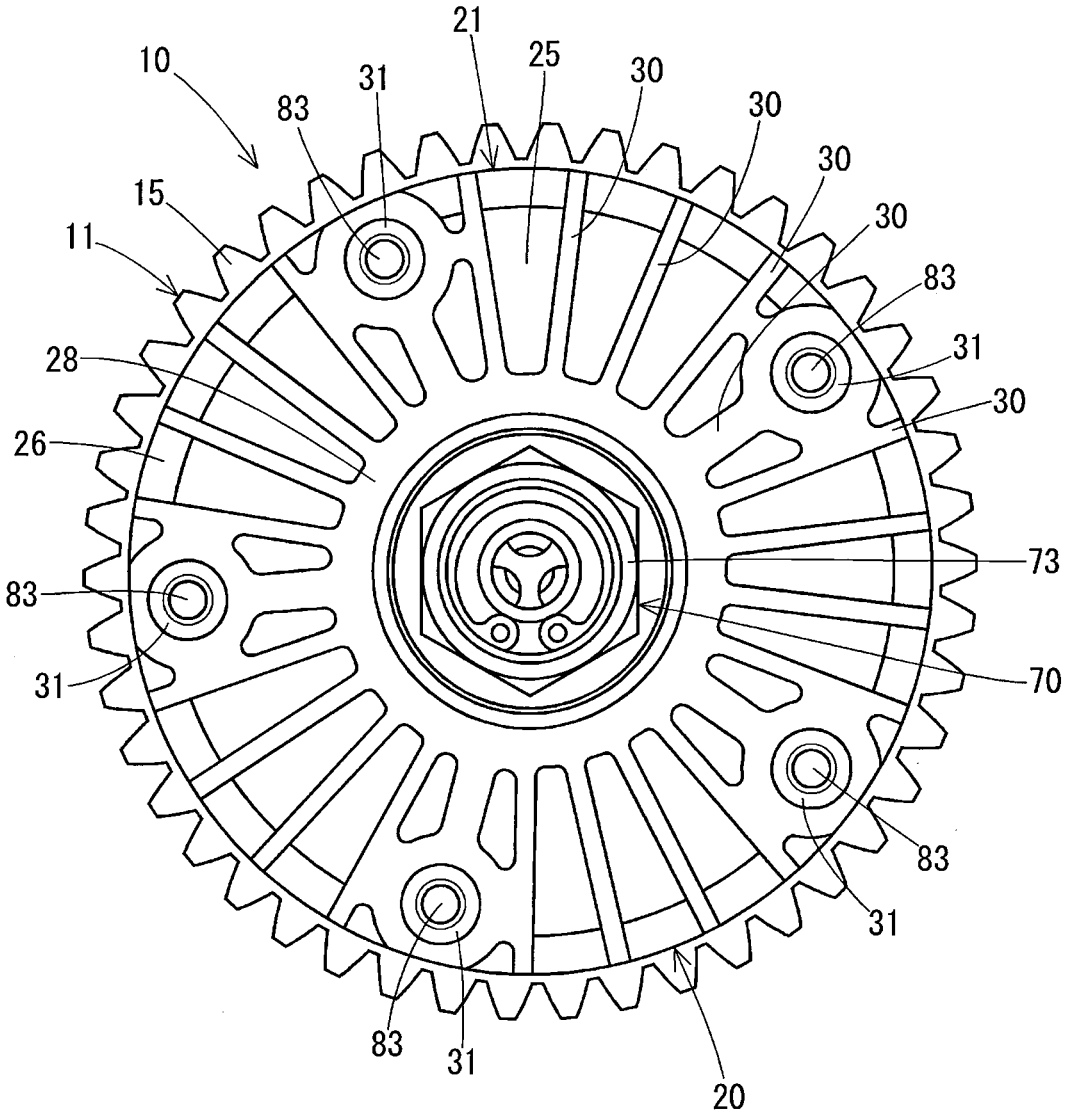
FIG. 3 is a side view illustrating the valve timing controller of the first embodiment seen from a housing side.
Figure 4:
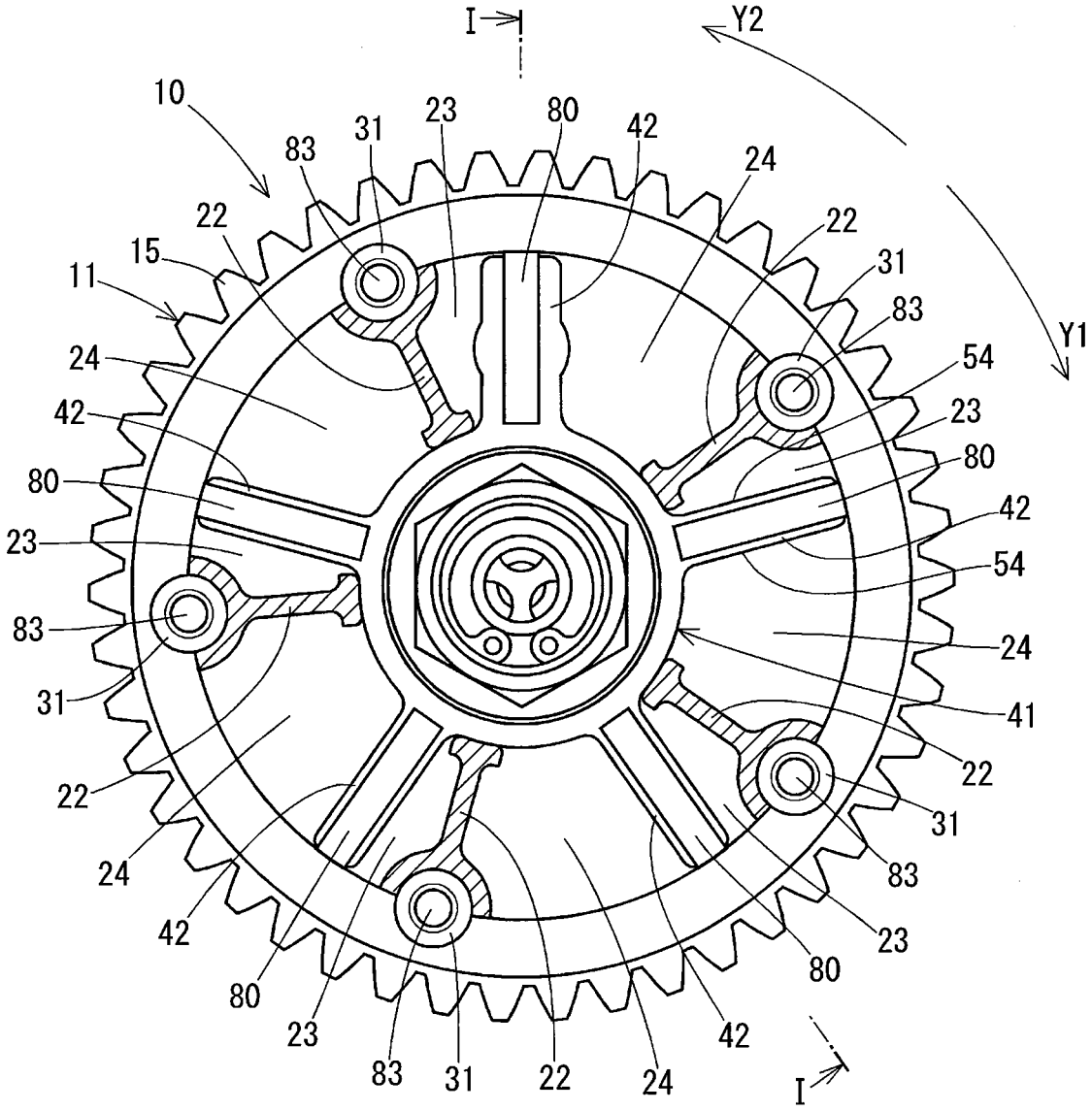
FIG. 4 is a side view illustrating the valve timing controller of FIG. 3 in which an outer shape part of the housing is omitted.
Figure 5:
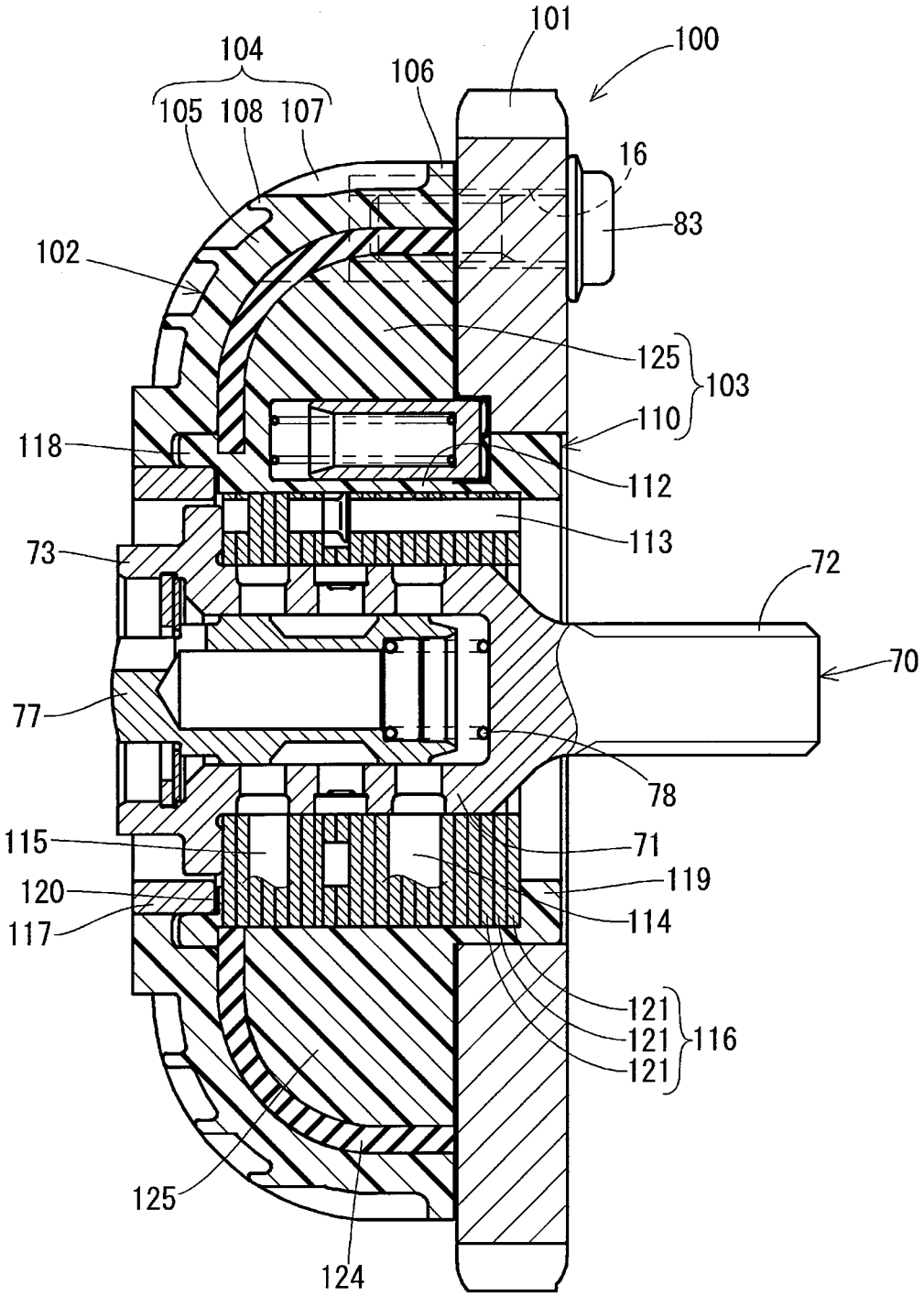
FIG. 5 is a cross-sectional view illustrating a valve timing controller according to a second embodiment.
Figure 6:
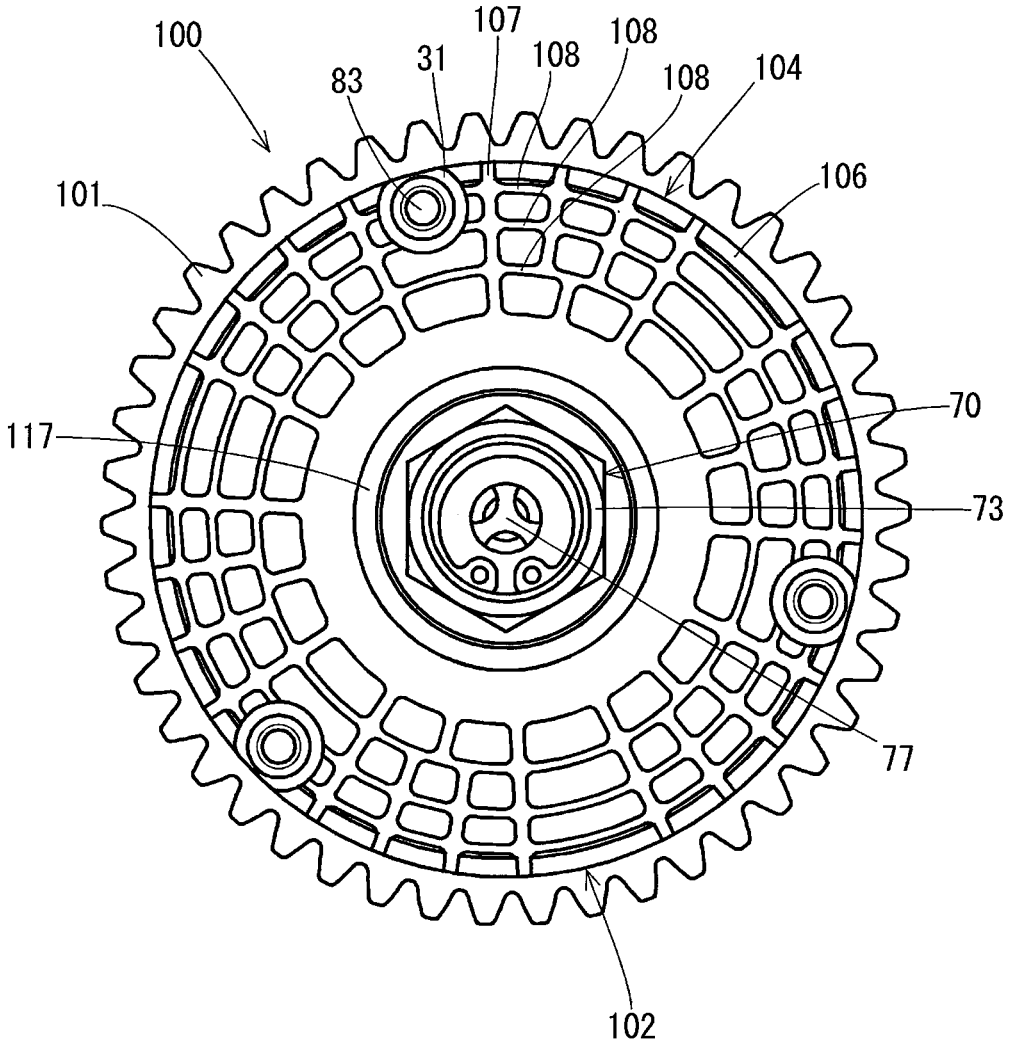
FIG. 6 is a side view illustrating the valve timing controller of the second embodiment seen from a housing side.
Figure 7:
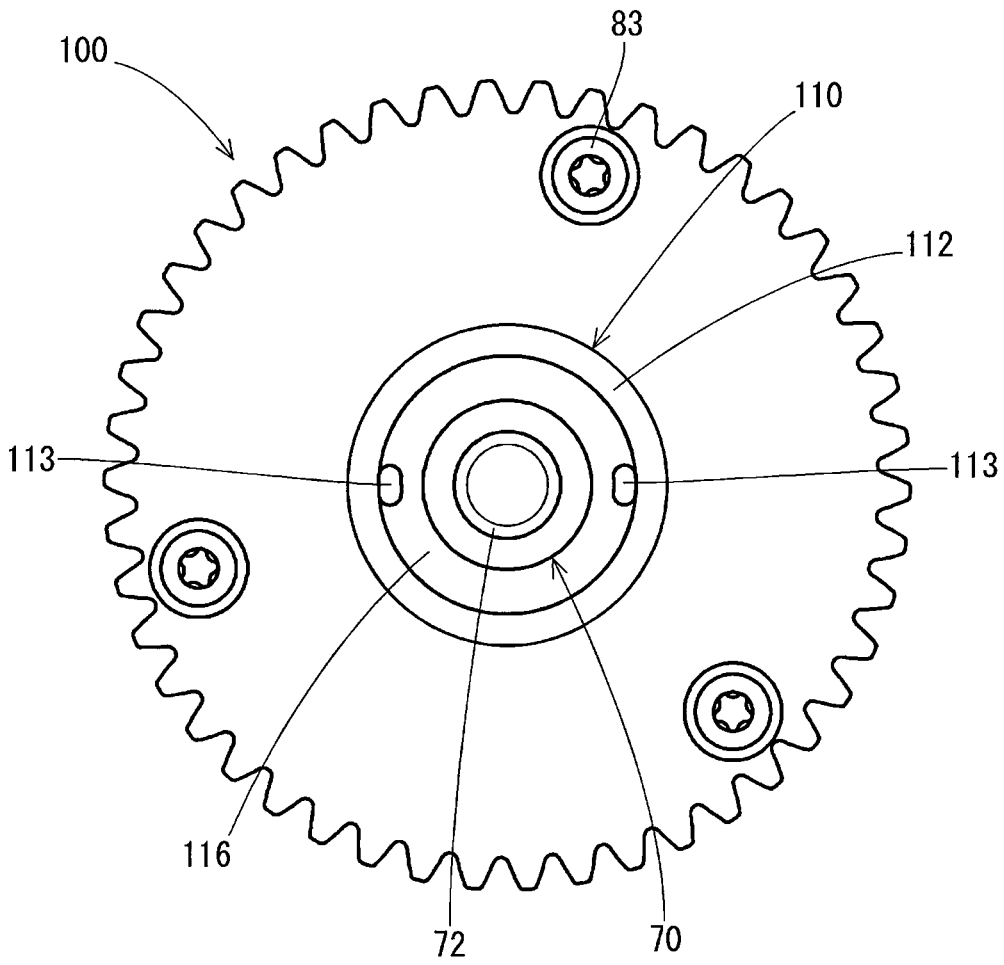
FIG. 7 is a side view illustrating the valve timing controller of the second embodiment seen from a sprocket side.
Figure 8:
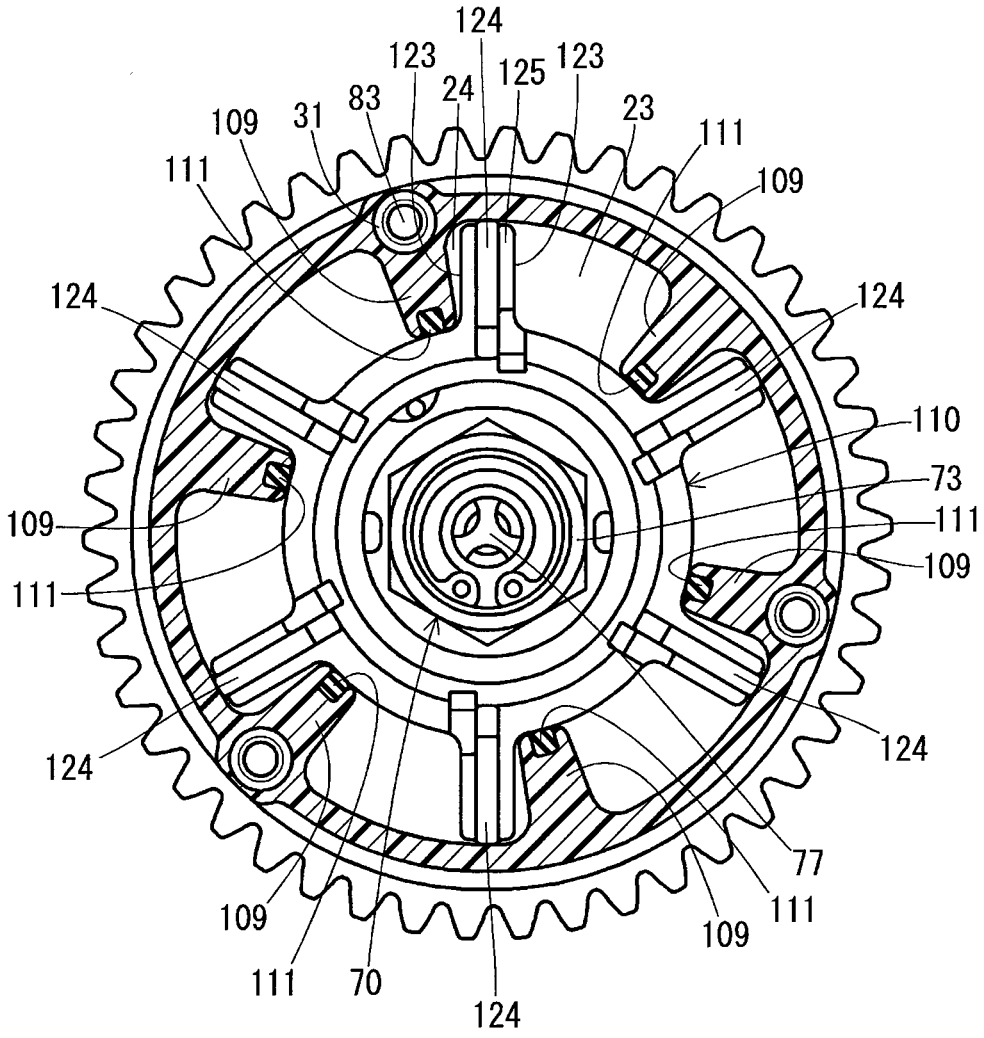
FIG. 8 is a side view illustrating the valve timing controller of FIG. 5 in which an outer shape part of the housing is omitted.

Next, the valve timing controller 10 is explained in more details based on FIGS. 1, 3, and 4.

The outer shape part 21 of the housing 20 has a dome shape, and has a dome part 25 and a rib part 30. In the first embodiment, the cross-sectional shape of the dome part 25 is made only from a curved part. An outer edge of the dome part 25 forms a flange part 26 projecting outward in the radial direction. The flange part 26 corresponds to a reinforcement member which raises the strength of the outer edge of the dome part 25. A seal plate 79 is disposed between the flange part 26 and the sprocket 11. The flange part 26 has a ring-shaped surface 27 which is in direct surface contact with the seal plate 79. The ring-shaped surface 27 corresponds to a seal member which seals a clearance between the housing 20 and the sprocket 11. A central portion of the dome part 25 defines an annular convex part 28 protruding in the axial direction. Moreover, the central portion of the dome part 25 has a central hole 29 in which the head part 73 of the sleeve bolt 70 is inserted.

The dome shape of the dome part 25 represents a shape where the dome part 25 is expanded in a direction separating from the sprocket 11, and a concave space is defined between the dome part 25 and the sprocket 11. Specifically, any cross-sectional shape of the dome part 25 may be made of only curved part. Alternatively, a cross-sectional shape of the dome part 25 may be made of a curved part and a tube portion extending from a radially outer surface of the curved part in the axial direction. Alternatively, a cross-sectional shape of the dome part 25 may be made of a curved part and a board portion extending from a radially inner surface of the curved part inward in the radial direction. Alternatively, a cross-sectional shape of the dome part 25 may be made of a curved part, a tube portion extending from a radially outer surface of the curved part in the axial direction, and a board portion extending from a radially inner surface of the curved part inward in the radial direction.

The rib part 30 radially extends from the annular convex part 28 to the flange part 26 along the dome part 25. That is, the rib part 30 continuously extends from the central portion to the outer circumference edge of the dome part 25. A thickness of the rib part 30 is larger than a thickness of the dome part 25.

The housing 20 is equipped with an insertion nut 31 which is arranged inside a connection section at which the outer shape part 21 and the partition part 22 are connected with each other. The insertion nut 31 also corresponds to a reinforcement member which raises the strength of a base end of the partition part 22.

The housing 20 is made of resin composite material. In the first embodiment, fiber-reinforced plastic is adopted as the resin composite material. The fiber-reinforced plastic is a composite material, and the strength of the composite material is raised by mixing reinforcing members such as glass fibers or carbon fibers in resin. The resin may be PA66, PPS, m-PPE, PEEK, PF, etc. and has heat resistance and oil resistance.

The sprocket 11 has an annular base 12 made or resin, an inner ring part 13 made of metal, and an outer ring part 14 made of metal. The inner ring part 13 is integrally formed with the inside part of the annular base 12, and is rotatably fitted to the camshaft 97. The outer ring part 14 is integrally formed with the outside part of the annular base 12, and has outer teeth 15 to which the chain 96 shown in FIG. 2 can be fixed. Moreover, the outer ring part 14 has a through hole 16 extending in the axial direction, and is fixed to the housing 20 by a bolt 83 inserted in the through hole 16. The annular base 12 is molded by pouring melt resin in a metallic mold to which the inner ring part 13 and the outer ring part 14 are set, so as to be solidified.

The boss part 41 of the vane rotor 40 includes a large diameter pipe part 50 having a relatively thin thickness, a small diameter pipe part 52, and an oil passage formation part 53. The small diameter pipe part 52 is made of metal, and has a surface 51 to which the sleeve bolt 70 is fixed. The oil passage formation part 53 is made of resin, and has the supply groove 43, the retard groove 44, the advance groove 45, the supply oil passage 46, the advance oil passage 47, and the retard oil passage 48.

The vane part 42 of the vane rotor 40 extends from the large diameter pipe part 50 of the boss part 41 outward in the radial direction, and is integrally molded with the large diameter pipe part 50. The vane part 42 is slidingly contact with the inner surface of the dome part 25 of the housing 20 and the side surface of the seal plate 79. A pressure receiving surface 54 of the vane part 42 has a sector shape with a central angle of 90 degrees. In other words, the pressure receiving area of the pressure receiving surface 54 is made to become smaller as extending outward in the radial direction.

The vane rotor 40 is fabricated by pouring melt resin in a metallic mold to which the small diameter pipe part 52, the first ring 61, the reed valve 62, and the second ring 63 are set, so as to be solidified.

A seal component 80 having an arch shape is arranged between the vane part 42 of the vane rotor 40 and the dome part 25 of the housing 20. The seal component 80 is made of elastomer such as synthetic rubber, and oil-tightly seals a clearance between the vane part 42 of the vane rotor 40 and the dome part 25 of the housing 20.

A biasing component 81 is arranged between the seal component 80 and the vane part 42 of the vane rotor 40. The biasing component 81 biases a first end part, an intermediate part, and a second end part of the seal component 80 toward the dome part 25 of the housing 20. In other words, the biasing component 81 biases the seal component 80 toward the dome part 25 of the housing 20 in the axial direction and the radial direction.

According to the first embodiment, the outer shape part 21 of the housing 20 of the valve timing controller 10 has the dome shape. Therefore, the pressure of the operation oil of the advance chamber 23 and the retard chamber 24 acts on the outer shape part 21 of the housing 20 uniformly, and stress concentration can be prevented. Thus, the required strength of the housing 20 can be made smaller. Accordingly, the design flexibility can be raised for the material, the thickness, the rib shape of the housing 20, and the size of the advance chamber 23 and the retard chamber 24.

According to the first embodiment, the housing 20 is made of resin composite material containing resin. Thus, even in the case where the housing 20 is made of resin composite material containing resin, because the outer shape part 21 of the housing 20 has the dome shape, the thickness can be made comparatively thin. Therefore, void is restricted from being generated in resin, accuracy of dimension can be raised by avoiding shrinkage, and the use amount of the resin can be reduced. Moreover, the material is light in weight and the flexibility is high in the rib shape, compared with a conventional metal housing, so the weight can be highly reduced.

According to the first embodiment, the housing 20 is made from the fiber-reinforced plastic containing the reinforcing members such as glass fiber or carbon fiber. Therefore, even if a crack is generated in the housing 20 due to unusually high pressure in the advance chamber 23 or the retard chamber 24, the progress of the crack is slow, so the breakage can be detected before resulting in the fatal damage.

According to the first embodiment, the outer shape part 21 of the housing 20 has the dome part 25 and the rib part 30 extending from the central portion to the outer edge of the dome part 25. Therefore, the rigidity of the housing 20 is raised without preparing a complicated rib, such that the housing 20 is easily and simply molded.

According to the first embodiment, the thickness of the rib part 30 in the radial direction is larger than the thickness of the dome part 25 in the radial direction. Therefore, even if the pressure of the advance chamber 23 or the retard chamber 24 becomes unusually high, the dome part 25 can be restricted from being damaged, due to the rib part 30.

According to the first embodiment, the insertion nut 31 is embedded inside the connection section of the outer shape part 21 and the partition part 22 of the housing 20, and has reinforced the base end part of the partition part 22.

According to the first embodiment, the outer edge of the dome part 25 of the housing 20 has the flange part 26. The flange part 26 raises the rigidity of the housing 20 and the sealing property between the housing 20 and the sprocket 11.

According to the first embodiment, the pressure receiving surface 54 of the vane part 42 of the vane rotor 40 has the sector shape with the central angle of 90 degrees. Therefore, the pressure receiving surface 54 of the vane part 42 is formed in a manner that pressure receiving area becomes small, as going outward in the radial direction. Thus, the stress applied to the base end of the vane part 42 can be reduced.

According to the first embodiment, the seal component 80 having the arch shape is arranged between the vane part 42 of the vane rotor 40 and the dome part 25 of the housing 20. Moreover, the biasing component 81 is arranged between the seal component 80 and the vane part 42 of the vane rotor 40. The biasing component 81 biases the seal component 80 toward the dome part 25 of the housing 20, in the axial direction and the radial direction. Due to the seal component 80 and the biasing component 81 both of which have the arch shape, the sealing of the dome-shaped housing 20 becomes possible.

According to the first embodiment, the boss part 41 of the vane rotor 40 includes the small diameter pipe part 52 made of metal and the oil passage formation part 53 made of resin. The small diameter pipe part 52 has the surface 51 to which the sleeve bolt 70 is fixed. The oil passage formation part 53 has the plural oil passages 43, 44, 45, 46, 47, 48 connected to the oil ports 74, 75, 76. The oil passage 43, 44, 45, 46, 47, 48 is simultaneously formed when the oil passage formation part 53 is molded with resin.

In a comparison example where a surface to which the sleeve bolt 70 is fixed is made of resin, the connection between the surface and the sleeve bolt 70 may become loose by creep phenomenon. In contrast, according to the first embodiment, the surface 51 is made of metal, so the connection between the surface 51 and the sleeve bolt 70 can be restricted from becoming loose.

Moreover, in a comparison example where the oil passage is formed in a metal component, the producing cost is increased because complicated processing is needed. In contrast, according to the first embodiment, the oil passage is formed in the resin component, the forming of the oil passage can be made comparatively easy at low cost.

According to the first embodiment, the sprocket 11 has the annular base 12 made of resin, the inner ring part 13 made of metal, and the outer ring part 14 made of metal. The inner ring part 13 is integrally formed to the inside of the annular base 12, and the outer ring part 14 is integrally formed to the outside of the annular base 12. The inner ring part 13 and the outer ring part 14 are made of metal because it is necessary to secure the strength, and the other part is made of resin. Thus, the weight can be highly reduced.

According to the first embodiment, the outer ring part 14 of the sprocket 11 has the through hole 16 extending in the axial direction, and is fixed to the housing 20 by the bolt 83 inserted in the through hole 16. Therefore, the drive torque of the chain 96 can be transmitted to the housing 20 not via the annular base 12 made of resin. Thus, the required strength of the annular base 12 can be made small, and the design flexibility becomes high in the shape of the annular base 12.

Second Embodiment

A valve timing controller 100 according to a second embodiment is explained based on FIGS. 5-11. The valve timing controller 100 includes the sprocket 101, the housing 102, and the vane rotor 103.

The outer shape part 104 of the housing 102 has a dome shape. A cross-sectional shape of the dome part 105 of the outer shape part 104 is constructed of a curved part, and a tube portion and a board portion respectively extending from the radially outer surface and the radially inner surface of the curved part. The outer edge of the dome part 105 has the flange part 106 projecting outward in the radial direction.

The outer shape part 104 has a radial direction rib part 107 and a circumference direction rib part 108. The radial direction rib part 107 extends radially from the central portion along the dome part 105 to the outer edge. The circumference direction rib part 108 extends in the circumference direction with a predetermined interval in the radial direction. The thickness of the radial direction rib part 107 and the circumference direction rib part 108 is larger than the thickness of the dome part 105.

Figure 9:
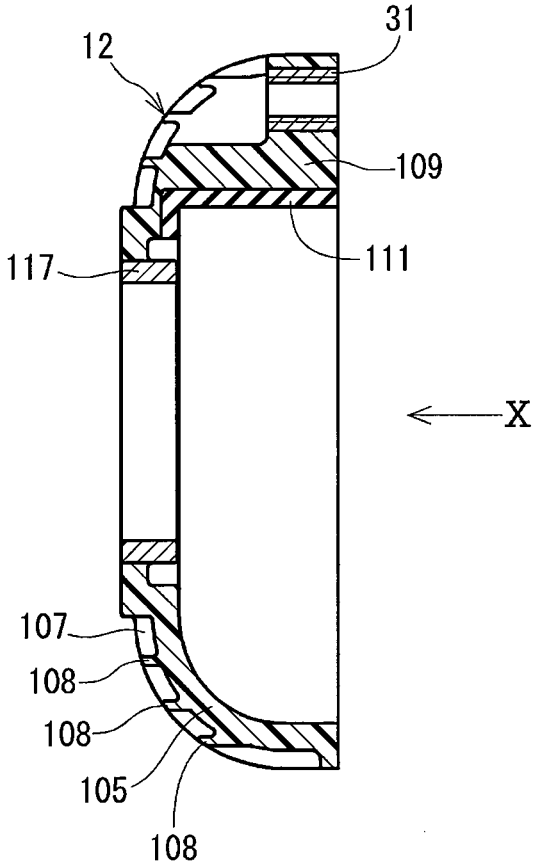
FIG. 9 is a cross-sectional view illustrating the housing of the valve timing controller of the second embodiment.
Figure 10:
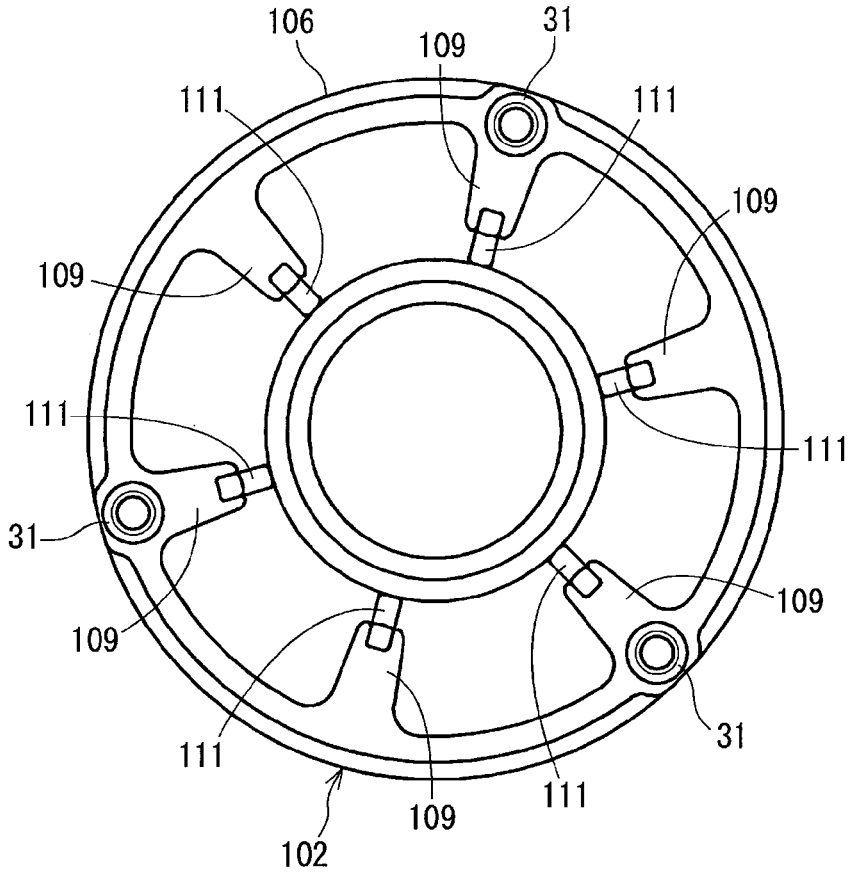
FIG. 10 is a view illustrating the housing of FIG. 9 seen in an arrow direction X.

The housing 102 is equipped with the insertion nut 31 disposed inside the connection section at which the outer shape part 104 and the partition part 109 are connected with each other, and is made of fiber-reinforced plastics. A clearance between the partition part 109 of the housing 102 and the boss part 110 of the vane rotor 103 is sealed by the seal component 111 having L shape, as shown in FIG. 9.

The boss part 110 of the vane rotor 103 has a pipe part 112 made of resin and having a thin cylindrical shape, and a metal layered object 116 having the supply oil passage 113, the advance oil passage 114, and the retard oil passage 115. The pipe part 112 has an annular projection 118 and flange projections 119, 120. The annular projection 118 projects in the axial direction, and is located radially outer side of a metal ring 117 fitted to the housing 102. The metal layered object 116 is interposed between the flange projections 119, 120 in the axial direction. A first axial end of the vane rotor 103 is supported by the metal ring 117, and a second axial end of the vane rotor 103 is supported by the sprocket 101.

Figure 11:
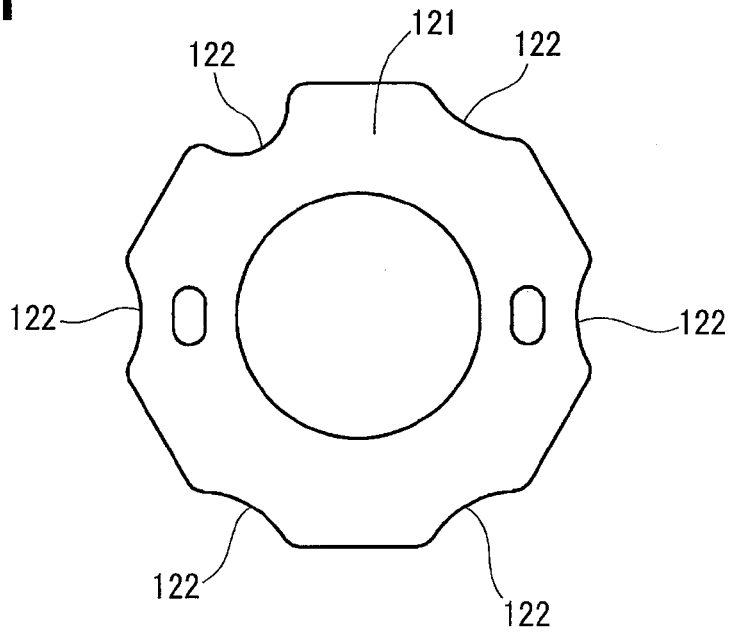
FIG. 11 is a plan view illustrating one of metal plates arranged in a vane rotor of the valve timing controller of the second embodiment.
Figure 12:
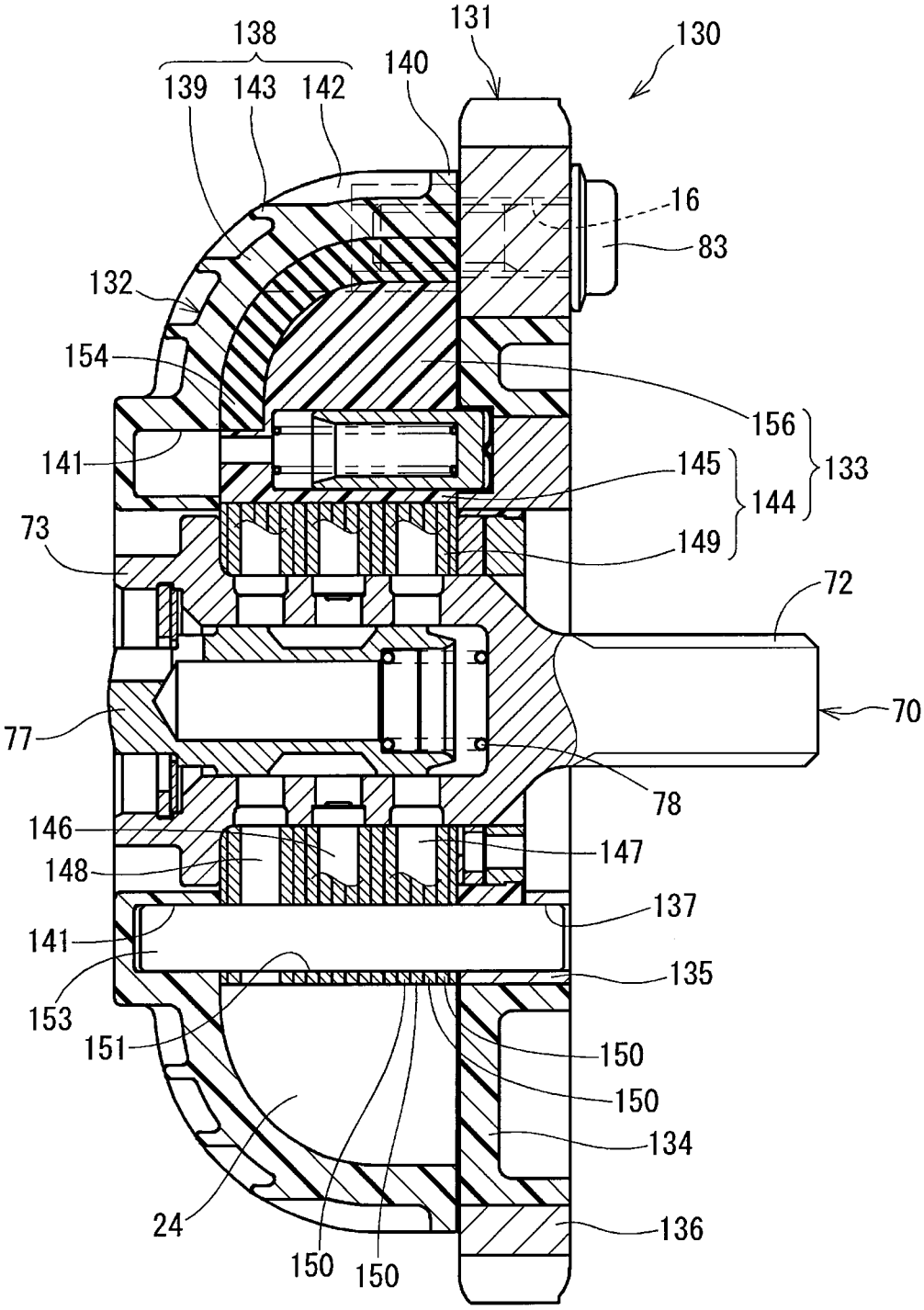
FIG. 12 is a cross-sectional view illustrating a valve timing controller according to a third embodiment.

The metal layered object 116 of the vane rotor 103 is constructed by plural metal plates 121 layered with each other in the axial direction. As shown in FIG. 11, the metal plate 121 has an annular shape, and has plural dents 122 on the perimeter. The metal plates 121 are layered with each other so that the positions of the dents 122 are in agreement with each other in the circumference direction.

The pressure receiving surface 123 of the vane part 125, made of resin, of the vane rotor 103 has a sector shape with a central angle of 90 degrees, and is formed in a manner that the pressure receiving area becomes smaller as going outward in the radial direction. The vane rotor 103 is fabricated by pouring melt resin in a metallic mold to which the metal layered object 116 is set, so as to be solidified.

The seal component 124 having an arch shape is arranged between the vane part 125 of the vane rotor 103 and the dome part 105 of the housing 102. The seal component 124 is made of elastomer such as synthetic rubber, and generates biasing force in the axial direction and the radial direction. The seal component 124 is fabricated by pouring melt rubber in a metallic mold to which the vane rotor 103 is set, so as to be solidified.

According to the second embodiment, the same advantages can be achieved as the first embodiment. Moreover, the first axial end and the second axial end of the vane rotor 103 are respectively supported by the metal ring 117 and the sprocket 101, so wearing between the partition part 109 of the housing 102 and the boss part 110 of the vane rotor 103 can be reduced.

Third Embodiment

A valve timing controller 130 according to a third embodiment is explained based on FIGS. 12-15. The valve timing controller 130 includes the sprocket 131, the housing 132, and the vane rotor 133.

Figure 14:
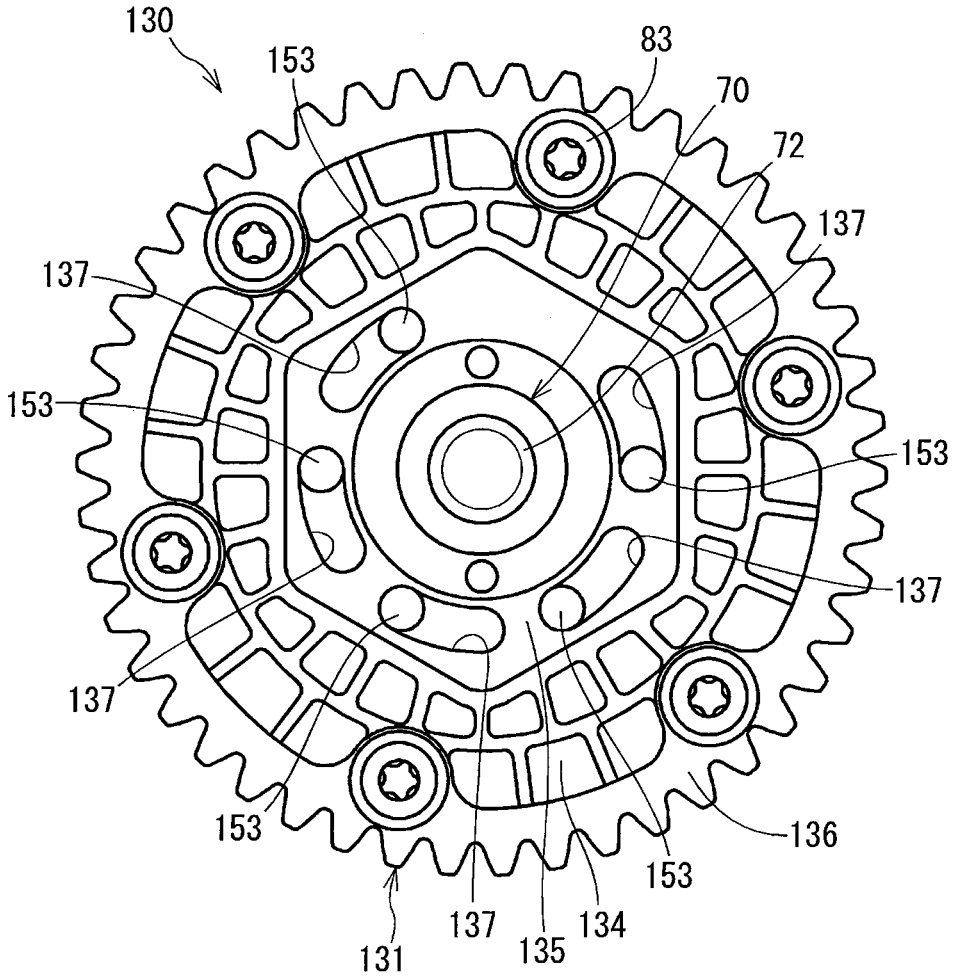
FIG. 14 is a side view illustrating the valve timing controller of the third embodiment seen from a sprocket side.
Figure 15:
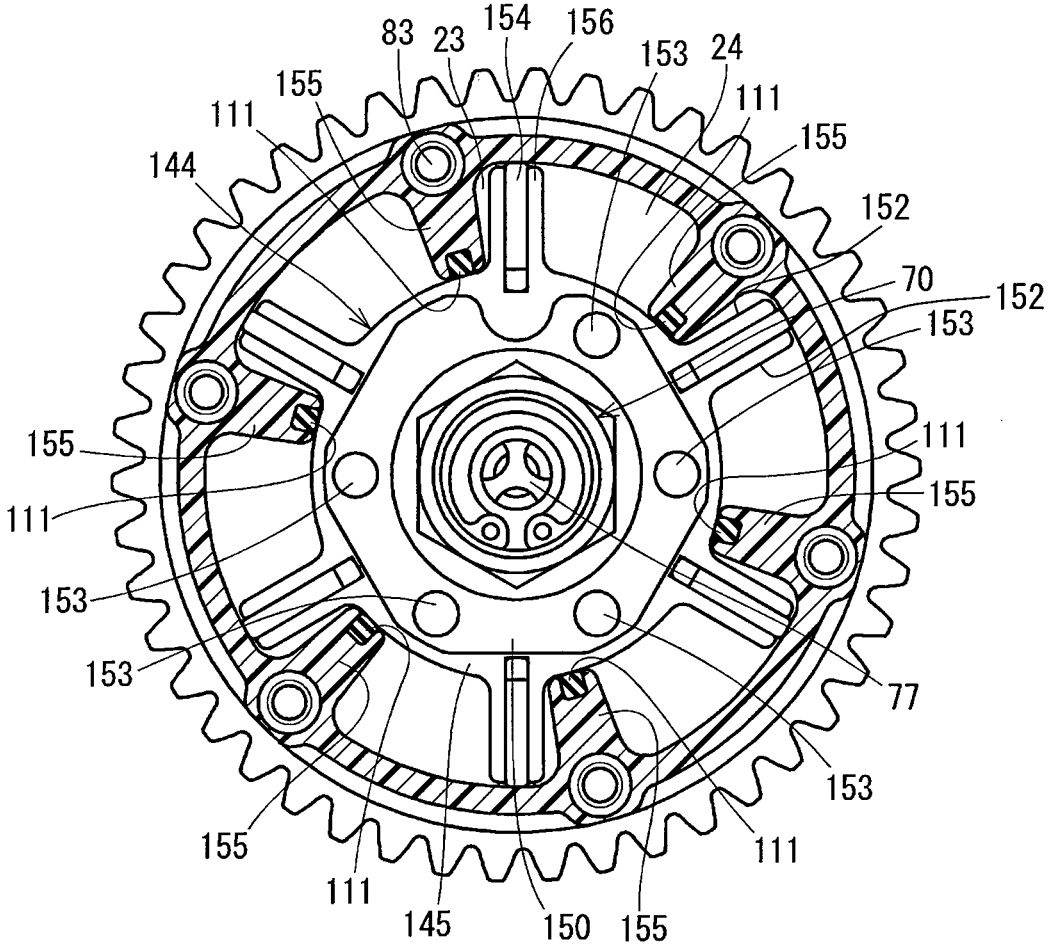
FIG. 15 is a side view illustrating the valve timing controller of FIG. 12 in which an outer shape part of the housing is omitted.

The sprocket 131 has the annular base 134 made of resin, the inner ring part 135 fixed to the inner side of the annular base 134, and the outer ring part 136 fixed to the outer side of the annular base 134. As shown in FIG. 14, the inner ring part 135 has a circumference direction hole 137 extending in the circumference direction.

Figure 13:
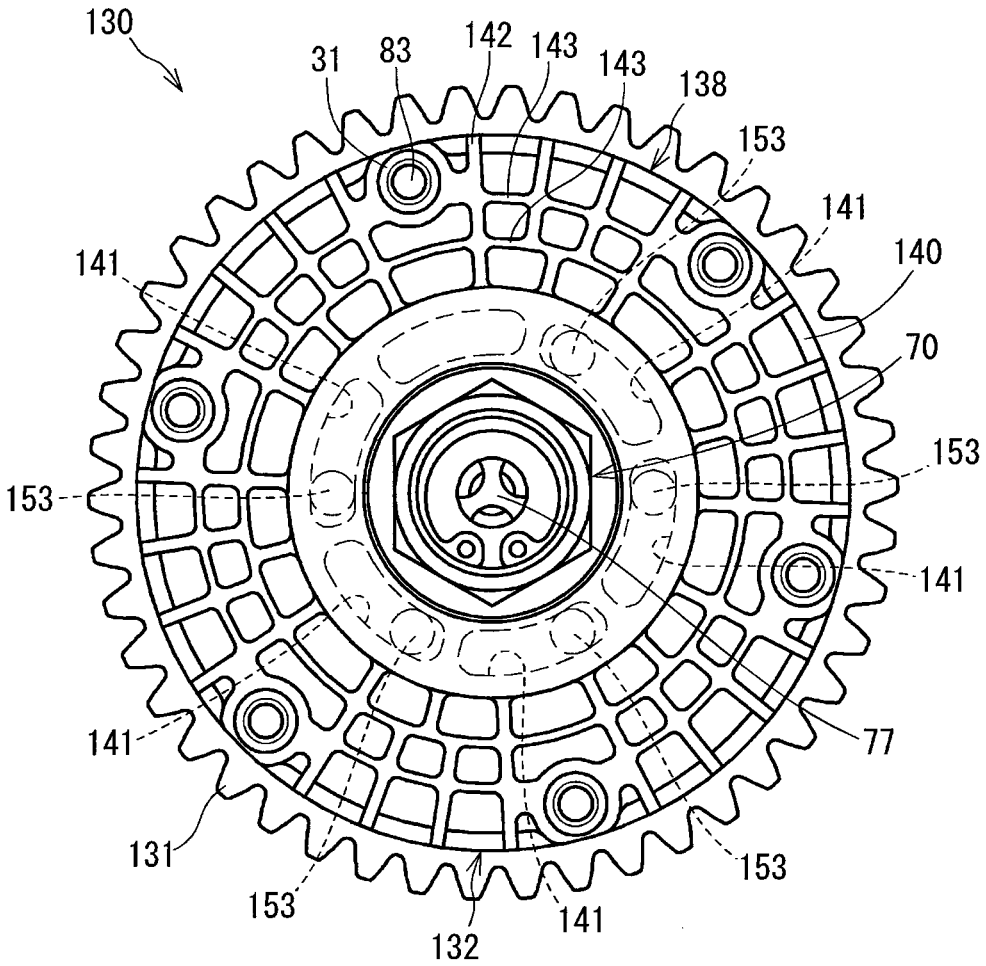
FIG. 13 is a side view illustrating the valve timing controller of the third embodiment seen from a housing side.

The outer shape part 138 of the housing 132 has the dome shape. A cross-sectional shape of the dome part 139 of the outer shape part 138 is constructed of a curved part, and a tube portion and a board portion respectively extending from the radially outer surface and the radially inner surface of the curved part. The outer edge of the dome part 139 has a flange part 140 projecting outward in the radial direction. As shown in FIG. 13, an inner wall of the central portion of the outer shape part 138 has a circumference direction hole 141 which extends in the circumference direction. The position of the circumference direction hole 141 is in agreement with the position of the circumference direction hole 137 in the circumference direction.

The outer shape part 138 has a radial direction rib part 142 extending radially from the central portion along the dome part 139 to the outer edge, and a circumference direction rib part 143 extending in the circumference direction with a predetermined interval in the radial direction. The thickness of the radial direction rib part 142 and the circumference direction rib part 143 is larger than the thickness of the dome part 139.

The housing 132 includes the insertion nut 31 disposed inside the connection section at which the outer shape part 138 and the partition part 155 are connected with each other, and is made of fiber-reinforced plastics. A clearance between the partition part 155 of the housing 132 and the boss part 144 of the vane rotor 133 is sealed by the seal component 111.

The boss part 144 of the vane rotor 133 has a pipe part 145 made of resin and having a thin cylindrical shape, and a metal layered object 149 having the supply oil passage 146, the advance oil passage 147, and the retard oil passage 148. The metal layered object 149 of the vane rotor 133 is constructed by plural metal plates 150 layered with each other in the axial direction. The metal plate 150 has a through hole 151 passing in the axial direction.

A pressure receiving surface 152 of the vane part 156, made of resin, of the vane rotor 133 has a sector shape with the central angle of 90 degrees, and the pressure receiving area becomes small as going outward in the radial direction. The vane rotor 133 is fabricated by pouring melt resin in a metallic mold to which the metal layered object 149 is set, so as to be solidified.

A bearing pin 153 is inserted and fitted to the through hole 151 of the metal layered object 149. A first end part and a second end part of the bearing pin 153 are projected from the metal layered object 149, and are respectively fitted to the circumference direction hole 137 of the sprocket 131 and the circumference direction hole 141 of the housing 132. The bearing pin 153, the circumference direction hole 137 and the circumference direction hole 141 correspond to a bearing portion which supports the vane rotor 133 in rotatable state relative to the housing 132.

The seal component 154 having the arch shape is arranged between the vane part 156 of the vane rotor 133 and the dome part 139 of the housing 132. The seal component 154 is made of elastomer such as synthetic rubber, and generates biasing force in the axial direction and the radial direction. The seal component 154 is fabricated by pouring melt rubber in a metallic mold to which the vane rotor 133 is set, so as to be solidified.

According to the third embodiment, the same advantages are achieved as the first embodiment. Further, the bearing pin 153 fixed to the vane rotor 133 is supported by the circumference direction hole 137 of the sprocket 131 and the circumference direction hole 141 of the housing 132, so wearing between the partition part 155 of the housing 132 and the boss part 144 of the vane rotor 133 can be reduced.

Fourth Embodiment

Figure 16:
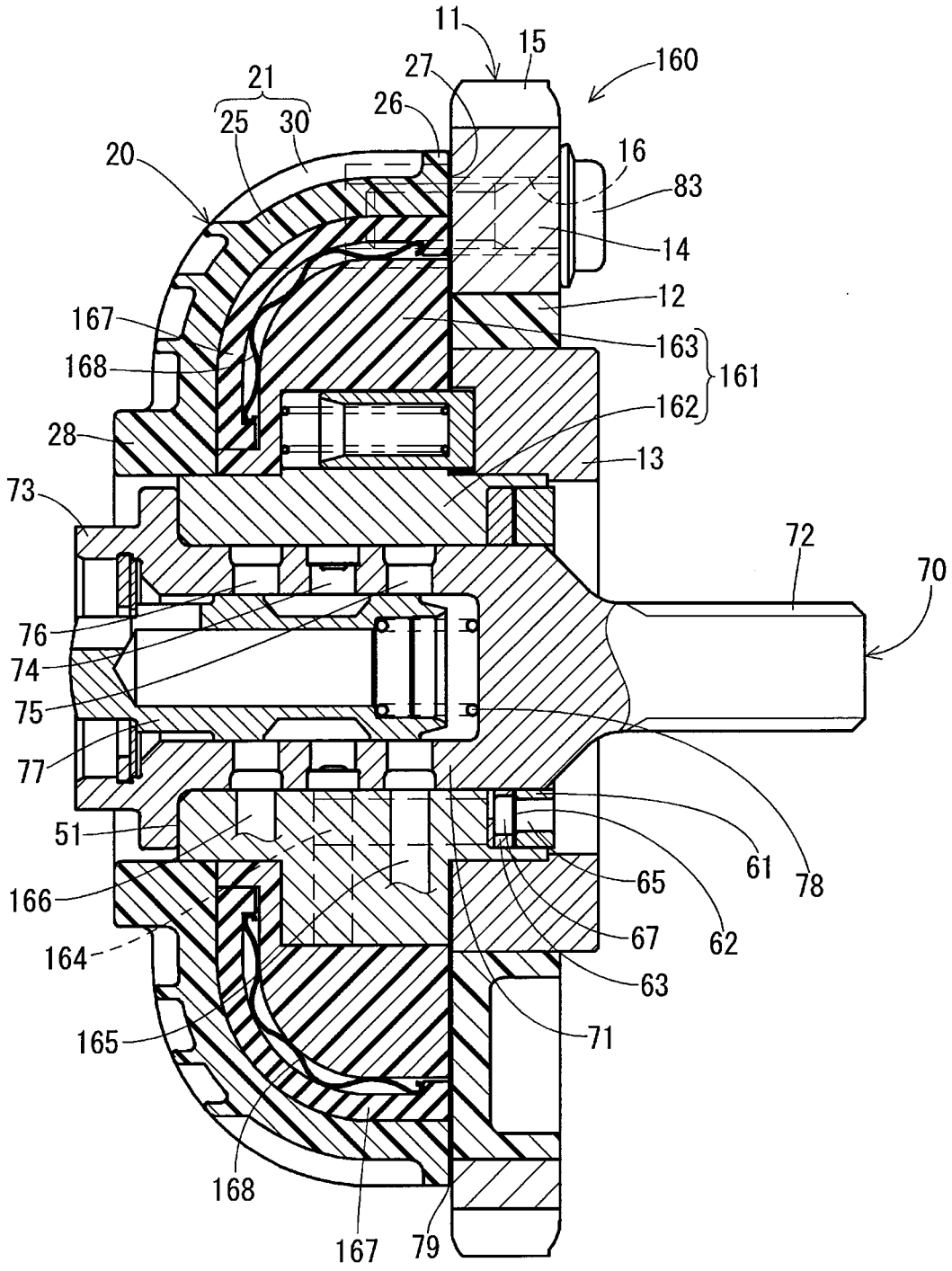
FIG. 16 is a cross-sectional view illustrating a valve timing controller according to a fourth embodiment.

A valve timing controller 160 according to a fourth embodiment is explained based on FIG. 16. The vane rotor 161 of the valve timing controller 160 has the boss part 162 made of metal and the vane part 163 made of resin. The supply oil passage 164, the advance oil passage 165, and the retard oil passage 166 are defined in the boss part 162, for example, by machine processing.

The biasing component 168 is arranged between the seal component 167 and the vane part 163 of the vane rotor 161. The biasing component 168 biases four positions between the first end part and the second end part of the seal component 168 toward the dome part 25 of the housing 20.

According to the fourth embodiment, the same advantages are achieved as the first embodiment.

Other Embodiment

The housing may be made from resin composite material other than the fiber-reinforced plastic, or resin. The number of the oil pressure chambers in the housing may be four or less, or may be seven or more. The rib part of the outer shape part of the housing may extend in a direction other than the radial direction. For example, when the rib part is formed to extend from the central portion of the housing in a tangential direction of a circle having the same rotation axis, the strength is raised. Moreover, the rib part may not extend from the inner edge to the outer edge of the housing. The rib part may be eliminated from the outer shape part of the housing.

The outer edge of the housing may not have the flange part. The thickness of the rib part of the outer shape part of the housing may be smaller than or equal to the thickness of the dome part. The insertion nut may be eliminated from the connection section between the outer shape part and the partition part. The sprocket may be made from only resin or only metal. The first ring and the second ring may be eliminated between the vane rotor and the camshaft. That is, the oil passage of the vane rotor may be directly connected to the oil passage of the camshaft.

The reed valve may be located at any position in the supply oil passage. The oil passage switch valve constructed by the sleeve bolt and the spool may be located at any position in the supply oil passage, and may not be located inside the vane rotor. The rotation of the crankshaft may be transmitted to the housing not only by the chain but by other power transmit member. The rotation transmit component may be other than the sprocket. The valve timing controller may control the opening-and-closing timing of the exhaust valve instead of the intake valve.

Such changes and modifications are to be understood as being within the scope of the present disclosure as defined by the appended claims.

What is claimed is:

1. A valve timing controller that controls opening-and-closing timing of an intake valve or an exhaust valve which is driven by a driven shaft by changing a rotation phase of the driven shaft to a driving shaft of an internal combustion engine, the valve timing controller comprising:

a rotation transmit component that is rotatable integrally with one of the driving shaft and the driven shaft;

a housing including an outer shape part fixed to the rotation transmit component and a plurality of partition arts extending from the outer shape part inward in a radial direction so as to partition inside of the outer shape part into a plurality of oil pressure chambers; and a vane rotor including a boss part which is rotatable integrally with the other of the driving shaft and the driven shaft inside the housing and a plurality of vane parts radially extending from the boss part so as to divide each of the oil pressure chambers into an advance chamber and a retard chamber, the vane rotor relatively rotating relative to the housing on an advance side or a retard side according to a pressure of operation oil in the advance chamber and the retard chamber, wherein the outer shape part of the housing has a dome shape, the outer shape part of the housing has a dome part and a rib part extending from a central portion to an outer edge of the dome part, and the rib part has a thickness which is larger than a thickness of the dome part.

2. The valve timing controller according to claim 1, wherein the housing is made of resin or resin composite material which contains at least resin.

3. The valve timing controller according to claim 1, wherein the housing is made of resin composite material which contains a reinforcing member.

4. The valve timing controller according to claim 1, further comprising:

an insertion nut disposed inside a connection section at which the outer shape part and the partition part are connected with each other, so as to reinforce the partition part.

5. The valve timing controller according to claim 1, wherein the outer shape part of the housing has an outer edge which is formed into a flange part.

6. The valve timing controller according to claim 1, further comprising:

a sleeve bolt penetrated in the boss part of the vane rotor and being capable to fix the boss part to the driven shaft, the sleeve bolt having a plurality of oil ports passing through the sleeve bolt in the radial direction; and a spool slidingly moving inside the sleeve bolt in an axial direction to switch the oil ports to communicate with each other or to be disconnected from each other, wherein the boss part of the vane rotor has a pipe part made of metal and an oil passage formation part made of resin, the pipe part has a surface to which the sleeve bolt is fixed, and the oil passage formation part has a plurality of oil passages which communicate with the corresponding oil port.

7. The valve timing controller according to claim 1, wherein the rotation transmit component has an annular base made of resin, an inner ring part made of metal, and an outer ring part made of metal, the inner ring part is fixed to inside of the annular base, and is capable of being fitted to the driven shaft, and the outer ring part is fixed to outside of the annular base and has outer teeth.

8. The valve timing controller according to claim 7, wherein the outer ring part of the rotation transmit component has a through hole passing in the axial direction, the valve timing controller further comprising:

a bolt inserted in the through hole to fix the rotation transmit component to the housing.

9. The valve timing controller according to claim 1, wherein the outer shape part of the housing is configured to receive the pressure of operation oil in the advance chamber and the retard chamber.

10. The valve timing controller according to claim 1, wherein the dome shape is defined by a shape that is an arch rotated around a central axis in an axial direction.

11. The valve timing controller according to claim 1, wherein housing is fixed to the rotational transmit component and is configured to receive the pressure of operation oil in the advance chamber and the retard chamber, such that the pressure of operation oil is uniformly applied to the outer shape part without a concentration of stress on the outer shape part.

12. A valve timing controller that controls opening-and-closing timing of an intake valve or an exhaust valve which is driven by a driven shaft by changing a rotation phase of the driven shaft to a driving shaft of an internal combustion engine, the valve timing controller comprising:

a rotation transmit component that is rotatable integrally with one of the driving shaft and the driven shaft;

a housing including an outer shape part fixed to the rotation transmit component and a plurality of partition parts extending from the outer shape part inward in a radial direction so as to partition inside of the outer shape part into a plurality of oil pressure chambers; and a vane rotor including a boss part which is rotatable integrally with the other of the driving shaft and the driven shaft inside the housing and a plurality of vane parts radially extending from the boss part so as to divide each of the oil pressure chambers into an advance chamber and a retard chamber, the vane rotor relatively rotating relative to the housing on an advance side or a retard side according to a pressure of operation oil in the advance chamber and the retard chamber, wherein the outer shape part of the housing has a dome shape the vane part of the vane rotor has a pressure receiving surface, and the pressure receiving surface has a sector shape with a central angle of 90 degrees.

13. The valve timing controller according to claim 12, further comprising:

a seal component having an arch shape that is arranged between the vane part of the vane rotor and the outer shape part of the housing.

14. The valve timing controller according to claim 13, further comprising:

a biasing component arranged between the seal component and the vane part of the vane rotor, wherein the biasing component biases the seal component toward the outer shape part of the housing in an axial direction and the radial direction.

15. A valve timing controller that controls opening-and-closing timing of an intake valve or an exhaust valve which is driven by a driven shaft by changing a rotation phase of the driven shaft to a driving shaft of an internal combustion engine, the valve timing controller comprising:

a rotation transmit component that is rotatable integrally with one of the driving shaft and the driven shaft;

a housing including an outer shape part fixed to the rotation transmit component and a plurality of partition parts extending from the outer shape part inward in a radial direction so as to partition inside of the outer shape part into a plurality of oil pressure chambers; and a vane rotor including a boss part which is rotatable integrally with the other of the driving shaft and the driven shaft inside the housing and a plurality of vane parts radially extending from the boss part so as to divide each of the oil pressure chambers into an advance chamber and a retard chamber, the vane rotor relatively rotating relative to the housing on an advance side or a retard side according to a pressure of operation oil in the advance chamber and the retard chamber, a bolt inserted in a through hole to fix the rotation transmit component to the housing, an insertion nut disposed inside a connection section at which the outer shape part and a corresponding partition part are connected with each other, such that the insertion nut is embedded inside the connection section of the outer shape part and the partition part of the housing and reinforces the partition part, wherein the outer shape part of the housing has a dome shape, the rotation transmit component has an annular base made of resin, an inner ring part made of metal, and an outer ring part made of metal, the outer ring part of the rotation transmit component has the through hole passing in the axial direction that receives the bolt that fixes the rotation transmit component to the housing, the inner ring part is fixed to inside of the annular base, and is capable of being fitted to the driven shaft, the outer ring part is fixed to outside of the annular base and has outer teeth, the outer shape part of the housing has an outer edge which is formed into a flange part that projects outward in the radial direction, the outer shape part of the housing has a dome part and a rib part extending from a central portion to an outer edge of the dome part, a central portion of the dome part defines an annular convex part protruding in the axial direction, the rib part radially extends from the annular convex part to the flange part along the dome part, such that the rib part continuously extends from the central portion to the outer circumference edge of the dome part, and the rib part has a thickness which is larger than a thickness of the dome part.

* * * * *